US006443664B1

(12) United States Patent
Horan et al.

(10) Patent No.: US 6,443,664 B1
(45) Date of Patent: Sep. 3, 2002

(54) METAL SHEET PILING

(75) Inventors: Michael John Horan, Doncaster; David Rowbottom, Scunthorpe; James Ronald Dudding, Brigg, all of (GB)

(73) Assignee: Corus UK Limited, London (GB)

( * ) Notice: Subject to any disclaimer, the term of this patent is extended or adjusted under 35 U.S.C. 154(b) by 0 days.

(21) Appl. No.: 09/744,241

(22) PCT Filed: Jul. 23, 1999

(86) PCT No.: PCT/GB99/02401

§ 371 (c)(1),
(2), (4) Date: Jan. 29, 2001

(87) PCT Pub. No.: WO00/08263

PCT Pub. Date: Feb. 17, 2000

(30) Foreign Application Priority Data

Jul. 31, 1998 (GB) ..... 9816698

(51) Int. Cl.[7] ..... E02D 5/08
(52) U.S. Cl. ..... 405/279; 405/281; 405/278
(58) Field of Search ..... 405/272, 274, 405/276, 277, 278, 279, 280, 281; 29/897.3, 897.32

(56) References Cited

U.S. PATENT DOCUMENTS

| | | | | | |
|---|---|---|---|---|---|
| 735,489 | A | * | 8/1903 | Friestedt | 405/281 |
| 839,608 | A | * | 12/1906 | Larssen | 405/276 |
| 884,545 | A | * | 4/1908 | Vanderkloot | 405/278 |
| 1,590,302 | A | | 6/1926 | Lindenlauf | |
| 3,703,085 | A | * | 11/1972 | Wogerbauer | 405/276 |
| 4,808,039 | A | | 2/1989 | Fischer | |
| 5,447,393 | A | * | 9/1995 | Yeates et al. | 405/276 |
| 5,782,583 | A | * | 7/1998 | Vales | 405/281 |
| 6,092,346 | A | * | 7/2000 | Even et al. | 405/281 |
| 6,106,201 | A | * | 8/2000 | Bourdouxhe | 405/281 |

FOREIGN PATENT DOCUMENTS

| | | |
|---|---|---|
| DE | 92 00 021 U | 2/1992 |
| FR | 2 648 493 A | 12/1990 |
| GB | 1 343 203 A | 1/1974 |

* cited by examiner

*Primary Examiner*—Heather Shackelford
*Assistant Examiner*—Frederick L. Lagman
(74) *Attorney, Agent, or Firm*—Bacon & Thomas, PLLC

(57) ABSTRACT

A metal sheet pile comprises a cold formed wall section to the longitudinally extending side edges of which are secured hot formed clutch sections (12). The clutch sections (12) may be produced by hot rolling, extrusion or other hot forming process and are preferably welded to the side edges of the pan or web by, for example, laser, submerged arc or resistance welding. Cold forming of the wall section from steel plate may be effected in a press, or by passing steel plate between or around cold bending rolls.

14 Claims, 3 Drawing Sheets

METAL SHEET PILING

Figure 1A:
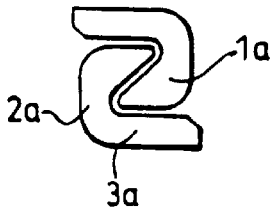

This invention relates to metal sheet piling. More especially, but not exclusively, the invention relates to steel sheet piling.

Steel sheet piles are used in general and marine engineering as permanent structures inter alia for retaining walls, basements, underground car parks, pumping stations, bridge abutments and marine structures. These are only examples of such structures.

Conventional sheet piles include those known as Larssen or LX sheet piles which are of generally "U" shape and comprise a wall section comprising a pan defined by a central flange flanked by outwardly inclined side walls along the free edges of which are integrally formed interlocks. These interlocks (also known as clutches) typically comprise a locking toe of generally triangular cross-section which stands proud of a lip which extends along each side edge of the pile, the lip lying generally normal to the adjoining pile surface. The space between the toe and the lip defines a recess for receiving a locking toe of an adjoining pile. The lip defines the bottom wall of this recess.

Other known sheet piles include Frodingham piles which are of generally "Z" profile and typically comprise a wall section including an inclined central web flanked by outwardly extending flanges along the free edges of which are formed interlocks.

Many variations and combinations of the sheet piles and clutches described are possible.

Steel sheet piles are conventionally produced by hot rolling. Typically, the required profile is produced by subjecting re-heated steel slab, bar or other suitable section to sequential rolling. The clutches are formed integrally during the course of this hot rolling.

A perceived disadvantage of hot rolling is that it is limiting as to the size and profile of sheet pile which can be produced using any given set of rolls.

Cold forming of clutch sections has previously been proposed. However, only relatively simple shaped clutches can be produced by cold forming. An example of such a clutch section is to be found in GB-A-1343203. This document discloses a pile which comprises an elongate web to the longitudinal edges of which are secured elongate flanges whose longitudinal edges are bent back towards the general plane of the web by cold roll bending to form hook-shaped clutch sections which are adapted to interlock with a similar clutch section of an adjacent pile. A similar sheet pile is disclosed in U.S. Pat. No. 2,093,208.

Sheet piles which comprise wall sections profiled by cold stamping and pressing from sheet metal blanks of the required length and width are disclosed in EP-A-164296. The sheet edges of adjoining piles are joined by connecting elements produced by cold stamping or laminating using bolts, rivets or welding.

Cold formed clutches have frequently been found not to provide the required interlock between adjoining sheet piles in service.

One object of the present invention is to provide a metal sheet pile which overcomes or at least alleviates many of the disadvantages to be found in existing sheet piles. Another object of this invention is to provide a method of making such improved metal sheet piles.

According to the present invention in one aspect, there is provided a sheet pile which comprises a cold formed wall section of sheet metal to the longitudinally extending side-edges of which are secured hot formed clutch sections.

The term "cold formed" when used in relation to steel or other metallic material means that the material has been subjected to a forming operation at a temperature below the hot forming temperature of the material; the term "hot formed" applies when the material has been subjected to a forming operation at a temperature at or above the hot forming temperature. In the case of hot forming, the deformation processes proceed at a rate which does not exceed the rate of the recovery processes which are themselves temperature dependent, being faster at higher temperatures; the converse is true for cold working or forming, where the recovery processes cannot keep pace with the deformation processes.

As mentioned above, the hot formed metal clutch sections are formed separately and not integrally with the steel sheet. The hot formed clutch sections may be produced by, for example, hot rolling or extrusion and are preferably welded to the side edges of the pan or web by, for example, laser, submerged arc or resistance welding. Other welding techniques may be employed. Alternatively, the clutch sections may be secured to the wall sections by, for example, bolts, rivets, adhesive or prestressed fastenings. The clutch sections are preferably produced from steel. Alternatively, the clutch sections may be produced from a non-ferrous material having the required physical properties.

Cold forming of the wall section from metal plate may be effected in a press, or by passing plate between or around cold bending rolls. Other cold forming processes may be adopted.

The gauge of the pan or web profile of a wall section and the clutch sections may differ one from the other. Also, for steel piles, the grade of steel employed for the wall sections may be the same or may differ from that employed for one or both clutch sections. Furthermore, the length of each clutch section may be the same as or shorter than the wall section side edge to which it is to be secured. With clutch sections whose length is less than the adjoining wall section side edge, more than one clutch section may be provided, the overall length of the clutch sections being equal to or less than the length of the respective wall section side edge. The clutch section profile positioned along one side edge of a wall section may differ from the profile of the clutch section positioned along the other side edge of the wall section. Such a pile may act, for example, as a transition pile.

In another aspect, there is provided a method of producing a metal sheet pile which comprises subjecting a metal plate to cold forming to produce in that metal plate the required wall profile of the finished sheet pile, subjecting separate lengths of metal to a hot forming operation to produce in those lengths the required clutch profile, and securing to one or each longitudinal edge of the cold formed metal wall section a hot formed clutch.

The metal plate to be cold formed may be cut to length and width prior to cold forming. The width may be achieved by rolling. Alternatively, plate of the required width and length may be slit or cut from larger plate. Cold forming may, for example, be effected in a press or by passage of the plate through or around a cold bending roll or rolls. Other cold forming techniques may be employed.

Steel for a clutch section may be in slab, rod or like form, or may be cut or slit from larger sheets of plate. Hot forming of the clutch sections may be effected, for example, by hot rolling or extrusion.

Conventional structural steels in alloy or non-alloy grades may be used for the cold formed wall sections. Such steels may also be used for the clutch sections.

One advantage of the present invention is that the thickness and/or geometry of the section is infinitely variable, Also, the overall depth of section, width of flanges and angle of bend can be varied to provide a finished product with specified geometry or with given engineering properties which may include inertia, section modulus, section area or unit width. It is believed that sheet piles in accordance with the invention will exhibit improvements in strength to weight ratio, measured in terms of section modulus per metre width to weight per square metre of product, when compared to conventional hot rolled sheet piles of equivalent strength.

With sheet piles in accordance with the invention, it is possible for the length or height of some sheet piles in an assembly of such piles to be curtailed, the longer sheet piles acting as primary piling and those whose length or height is curtailed acting as secondary piling. The length of curtailed secondary piles may be 40% or more of the length of the primary piles.

Figure 2:
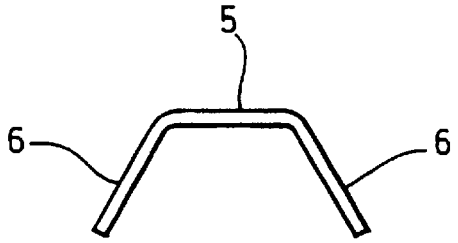
Figure 3:
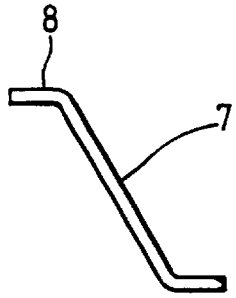

The invention will now be described, by way of example only, with reference to the accompanying diagrammatic drawings, in which:

FIGS. 1*a* to 1*g* are end views of pairs of typical interlocking hot formed clutch sections of sheet piles in accordance with the invention;

FIGS. 2 and 3 are end views of typical cold formed wall sections of sheet piles in accordance with the invention; and FIGS. 4 to 10 illustrate profiles of various sheet piles in accordance with the invention.

Where appropriate, the same reference numerals are used for the same or similar integers illustrated in the drawings.

The clutch sections shown in FIGS. 1*a* to 1*g* would conventionally be formed integrally by a hot forming process with the pile wall section, one such clutch section being provided along each side edge of the wall section. Conventionally, a wall section would include a pan defined by a central flange flanked by outwardly inclined side walls. In the present invention, the clutch sections illustrated in FIGS. 1*a* to 1*g* are formed separately by a hot forming operation.

The clutch sections illustrated in FIG. 1*a* are hot formed and are of the Larssen type. Each comprises a locking toe 1*a* of generally triangular cross-section, a sideways extending lip 2*a* and a flange 3*a* for later connection to a wall section of a sheet pile. The space defined between the toe 1*a,* the lip 2*a* and the flange 3*a* of each clutch section defines a recess capable of receiving the toe of the clutch section of a neighbouring sheet pile. In use, therefore, the clutch sections define the links between neighbouring sheet piles.

Figure 1B:
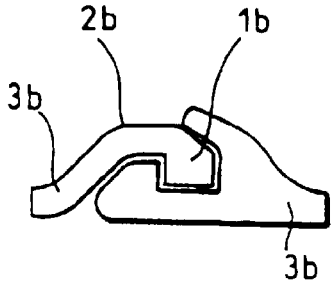
Figure 1C:
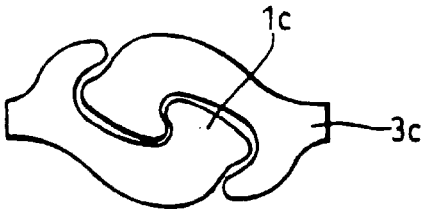

The hot formed clutch sections illustrated in FIG. 1*b* are of the Frodingham-type and comprise female and male clutch sections. The male clutch section comprises a locking toe 1*b,* a lip 2*b* and a flange 3*b*. The female clutch section is shaped to complement that of the male clutch section. The female clutch section also has a flange 3*b*. Cold formed wall section s are subsequently secured to the flanges 3*b*.

The hot formed clutch sections illustrated in FIG. 1*b* are of the Frodingham flat web type and comprise interengaging locking toes 1*c* and flanges 3*c*. As for the previously discussed clutch sections, cold formed wall sections are subsequently secured to the flanges 3*c*.

Figure 1D:
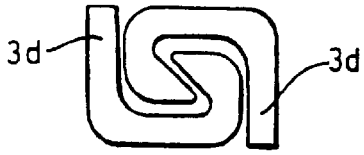

FIG. 1*d* illustrates alternative Larssen-type hot formed clutch sections whose flanges 3*d* are turned through 90° to provide a more secure interlock. As for the clutch sections of FIGS. 1*a* to 1*c,* these are subsequently secured to the side edges of cold formed wall sections.

Figure 1E:
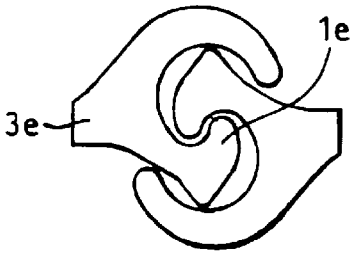

FIG. 1*e* illustrates a still further hot formed clutch section profile of the three point contact type for flat web piles which includes a locking toe 1*e* and flange 3*e* for attachment to one side of a cold formed wall section of a sheet pile in accordance with the invention.

Figure 1F:
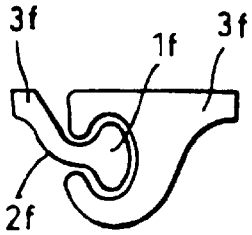

FIG. 1*f* illustrates an alternative male/female hot formed clutch section where the locking toe 1*f* is ball-shaped and engages with the female socket. The male section has a lip 2*f* and a flange 3*f*. The female section also has flange 3*f*.

Figure 1G:
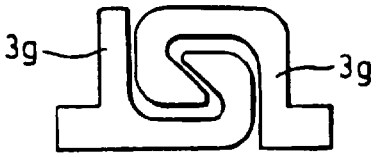

FIG. 1*g* shows a hot formed clutch profile section similar to that illustrated in FIG. 1*d* but includes an additional stub 4*g* to facilitate attachment to plate sections. The flanges or stubs of the clutch sections of FIGS. 1*f* and 1*g* are subsequently secured to the side edges of separately cold formed wall sections.

Other hot formed clutch section profiles may be provided.

As mentioned, to produce the required clutch section profile, lengths of steel slab, bar or other suitable section are subjected to hot forming. Alternatively, these lengths may be cut from larger sheets. The steel composition is typically that used for structural applications in both alloyed and non-alloyed grades. In practice, the particular grade of steel used is selected to suit the requirements of the sheet pile or piles to be produced.

Hot forming of the clutch geometry ensures the required interaction between joined neighbouring sheet piles to maintain an interlocking connection able to resist applied loads during installation and in service, especially those loads which are applied in directions which, unless resisted, would act to open the joint between neighbouring sheet piles. The interlocking connection is also required to transfer stress across the joints through physical interaction or friction and to provide a complex path to limit water flow in service. It has been found that the required interaction is not satisfactorily achieved with clutch section geometries produced by cold forming.

Interlocks or clutch sections formed integrally along the side edges of traditional cold formed piling (trench sheets and similar) are generally in the form of simple hooks which allow adjacent elements to be aligned to one another but have a tendency to open out or spread in service thereby resulting in a loosening of the connections. A simple hook arrangement provides limited interaction between adjacent piles and results in limited resistance to water flow between neighbouring sheet piles and limited structural benefit in terms of stress transfer at the connection.

There are, therefore, substantial disadvantages which accrue through the use of cold formed clutch sections. Conversely, there are substantial benefits to be achieved through the use of hot formed clutch sections.

The cold formed sheet pile wall section illustrated in FIG. 2 is typical of "U" shaped Larssen and LX piles and comprises a pan defined by a flange 5 and outwardly inclined webs 6.

A typical "Z" shaped cold formed wall section is illustrated in FIG. 3 and comprises a central web 7 bordered by outwardly inclined flanges 8. Other cold formed wall section profiles can be employed, examples of which are described below.

Wall sections in accordance with the invention are produced by subjecting metal plate (preferably steel plate) of the required composition, width, length and gauge to a cold forming operation. The steel composition is typically that used for structural applications in both alloyed and non-alloyed grades. Other more or less sophisticated steel grades may, however, be employed. The dimensions and composition can be selected to meet the particular service requirements of the sheet pile to be produced.

The plate is typically cut to length and width prior to or following cold forming. The required plate dimensions may be achieved by rolling; alternatively, plate of the required length and width may be slit or cut from a larger plate.

Cold forming may be effected by any known technique. In one embodiment, the plate profile is produced in a press; alternatively or additionally, the plate is passed through or around one or more cold bending rolls.

Forming the wall section by pressing and/or bending enables the properties of the finished profile to be tailored to suit the particular requirements of end-users of the sheet piles.

Cold forming also enables the same profile to be produced in a range of gauges, widths and/or lengths. This enables the material used to be optimised when catering for specific situations such as difficult driving conditions or corrosion requirements without necessarily affecting the outward appearance of the finished sheet pile.

The ability to produce sections to the same profile but in different thickness or grade of steel permits fabrication of piles by joining together a number of wall sections end to end. Thus, individual wall sections may be secured together by, for example, resistance, submerged arc or laser welding. Other welding techniques may be employed. Alternatively, the cold formed wall sections may be joined, for example, by bolts, rivets, adhesives and prestressed fastenings. The advantage of this is that the strength profile of the finished section may be varied along its length by the introduction of thicker sections or sections having enhanced strength characteristics. Similarly, enhanced corrosion resistance can be incorporated into the piles at particular locations by the introduction of thicker sections or sections manufactured from corrosion resistant steel grades.

The geometry of sheet piles produced by conventional hot rolling is constrained by the capability of the rolling mill and the size of feedstock which is available. Conversely, cold forming does not impose constraints on profile geometry.

There are, therefore, substantial benefits to be achieved through the use of cold formed wall sections.

Once formed, the clutch sections are secured through their flanges or stubs 3 to the longitudinally extending side edges of the wall sections. The connection between the clutch and wall sections may be effected before or after cold forming of the wall sections to the required profile. On occasions when wall sections are fabricated by welding or otherwise securing together individual wall sections end-to-end, the clutch sections preferably extend over the entire height of the fabricated sheet pile. Alternatively, the clutch sections may extend over only a part of the length of the wall section to which the clutch sections are to be secured thereby producing reductions in the weight of material and improvements when driving the piles into the ground. This is because, with sheet piles in accordance with the invention, the clutch sections are required only to maintain alignment and to prevent the passage of soil and/or water. This is not possible with conventional sheet piles because the entire length of such a pile is required to be passed through shaped rolls. With sheet piles in accordance with the invention, it is also possible to secure two or more relatively short spaced hot formed clutch sections to one or each side of the cold formed wall section.

Typically, the hot formed clutch sections are welded to the wall sections. Welding may, for example, be achieved by resistance welding, submerged arc welding or laser welding. Any suitable welding technique may however be employed. When welding is to be effected, it is of course necessary to ensure that the metals of the clutch and wall sections are compatible for this purpose.

Other connection techniques may be employed. Thus, the clutch sections may, for example, be attached to the wall sections by bolts, rivets, adhesive or prestressed fastenings.

An essential feature of the invention as now described is that the wall sections are produced by cold forming and the interlock or clutch sections by hot forming, thereby benefitting from the advantages of both forming techniques.

Typical profiles of steel sheet piles in accordance with the invention are illustrated in FIGS. 4 to 10. It is to be understood, however, that these are merely examples of profiles which can be achieved by this invention.

Figure 4:
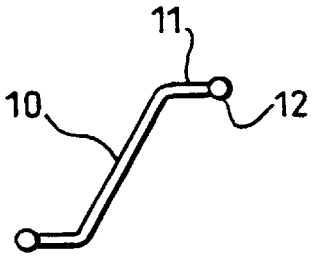

The sheet pile illustrated in FIG. 4 has a typical single "Z" profile which comprises a central inclined web 10 flanked by outwardly extending flanges 11 to which are secured clutch sections 12.

The profile of the wall section of this pile can readily be achieved by a pressing or cold rolling operation, the hot formed clutch sections subsequently being welded to the longitudinally extending sides of the wall section.

Figure 5:
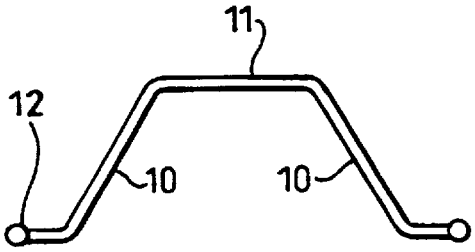

The sheet pile illustrated in FIG. 5 has a double "Z" profile. Previously this would be achieved by connecting two single "Z" piles together by interlocks. The present invention enables this double "Z" profile to be achieved without the need for additional clutch sections. Fabrication of profiles with the minimum number of clutch sections results in improved properties when compared to presently available sheet piling. Thus, the potential for water seepage through an assembled structure is minimised.

Figure 6:
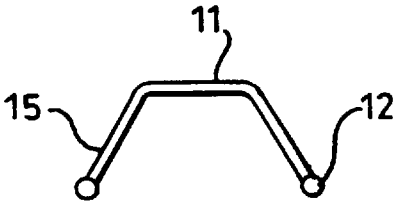

FIG. 6 illustrates a typical "U" profiled cold formed sheet pile which includes a pan comprising a central flange 14 bordered by outwardly inclined webs 15 to which are secured hot formed clutch sections 12.

Figure 7:
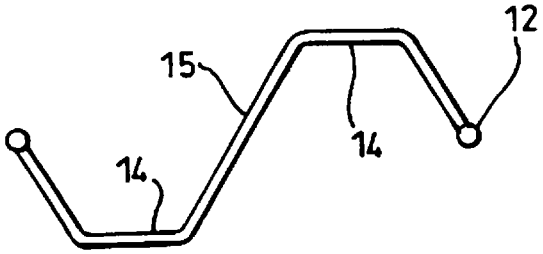
Figure 8:
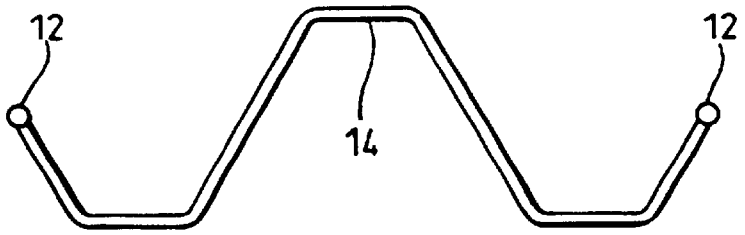

FIGS. 7 and 8 illustrate respectively sheet piles of double and triple "U" profile. As for the double "Z" profile, these profiles would conventionally only be achieved by connecting two and three sheet piles of single "U" profile together by clutch sections. The advantages discussed above apply to these double and triple profiles. The profiles can readily be achieved by cold forming.

Figure 9:
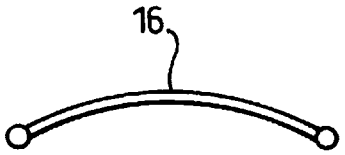
Figure 10:
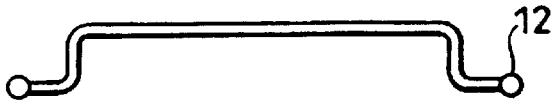

FIG. 9 illustrates a sheet pile which simply comprises a cold formed flat steel web 16 flanked by hot formed clutch sections 12. The web 16 of the sheet pile shown in FIG. 9 is curved, the required degree of curvature readily being produced by cold pressing or cold rolling.

An arch profile is illustrated in FIG. 10, this profile again being readily produced by cold forming.

These and many other combinations of sheet piles can readily be achieved from a combination of the pile profile discussed. Also, the ability to customise profiles through cold forming of the pile wall section is extremely advantageous when designing such pile structures.

Advantages of sheet piles in accordance with this invention include the following:

an ability to fabricate profiles with the minimum number of clutch sections; this results in relatively improved properties;

an ability to increase the width of wall sections; this reduces the number of installation operations required for a given plan length of wall;

reduced potential for water seepage through adjoining sheet piles because of a reduction in the number of clutch sections;

an ability to fabricate wall sections from steel plate to which interlocks are secured; this enables piles to be produced which give the end-user a choice of interlock design;

an ability to form the wall sections by bending thereby enabling the properties of the finished profile to be tailored to suit the requirements of the end-user, i.e. an ability to specially design piling rather than a need to select a nearest suitable section from a set range;

an ability to form the wall sections in a range of thicknesses. This enables designers to optimise the use of materials when catering for specific situations such as difficult driving conditions or corrosion requirements, without affecting the outward appearance of the structure;

an ability to produce sections to the same profile but in different thickness or grade of metal thereby permitting fabrication of piles by joining together a number of wall sections end-to-end. The advantage of this is that the strength profile of the finished wall section can be varied over its length/height by the introduction of thicker sections. Similarly, extra corrosion resistance can be incorporated into the piles at particular locations by the introduction of thicker sections or sections manufactured from corrosion resistant metal grades;

an ability to produce wall profiles which would otherwise need to be produced from multiple hot rolled sections (i.e. double "Z" or "U" or triple "U" profiles);

an ability to develop designs for multiple piles which ensure that the neutral axis of a wall section is not offset from the central axis of the pile structure thereby improving the bending characteristics of the unit;

an ability to produce piles to any width to suit particular requirements thereby reducing the number of clutch sections and hence the weight of steel required for a given structure and also involving fewer pitching operations when the piles are being installed;

an ability to install piles such that their main axes are at an angle to one another; and an ability to use a curved plate between the interlocks eliminates the need to rotate adjacent piles at the clutch sections to form the circle during construction. All tensile forces will consequently act along the axis of the clutch sections rather than at an angle improving their efficiency.

The range of thicknesses of the steel plate from which the sheet piles are to be produced is open ended. The formation process applies to all thicknesses of plate material.

It will be appreciated that the foregoing is merely exemplary of metal sheet pile in accordance with the invention and that modifications can readily be made thereto without departing from the true scope of the invention as set out in the appended claims.

What is claimed is:

1. A method of producing a metal sheet pile which comprises subjecting a metal plate to cold forming to produce in that plate the required wall profile of the finished pile, subjecting separate lengths of metal to hot forming to produce in those lengths the required clutch profile, and securing to one or each longitudinal edge of the cold formed wall section a hot formed clutch section.

2. A method as claimed in claim 1 wherein the metal plate to be cold formed is cut to length and width prior to cold forming.

3. A method as claimed in claim 1 wherein cold forming is effected in a press or by passage of the plate through or around a cold bending roll or rolls.

4. A method as claimed in claim 1 wherein hot forming of the or each clutch sections is effected by hot rolling or extrusion.

5. A metal sheet pile formed according to the method recited in claim 1.

6. A sheet pile as claimed in claim 5 wherein the clutch sections are produced by hot rolling.

7. A sheet pile as claimed in claim 5 wherein the clutch sections are extruded.

8. A sheet pile as claimed in claim 5 wherein the clutch sections are welded to the side edges of the wall section.

9. A sheet pile as claimed in claim 8 wherein the clutch sections are welded by laser, submerged arc or resistance welding.

10. A sheet pile as claimed in claim 5 wherein the clutch sections are secured to the wall sections by bolts, rivets, adhesive or prestressed fastenings.

11. A sheet pile as claimed in claim 5 wherein the wall section is produced from metal plate and wherein cold forming is effected in a press or by passing metal plate between or around cold bending rolls.

12. A sheet pile as claimed in claim 5 wherein the gauge of the wall section differs from the gauge of the clutch sections.

13. A sheet pile as claimed in claim 5 wherein the metal is steel.

14. A sheet pile as claimed claim 13 wherein the grade of steel employed for the wall section differs from the grade of steel employed for the clutch sections.

* * * * *